US007249994B2

(12) United States Patent
Sommacal

(10) Patent No.: US 7,249,994 B2
(45) Date of Patent: Jul. 31, 2007

(54) ABRASIVE CLEANING PLANT WITH SINGLE-BLOCK PLASTIC BOOTH AND INTEGRATED FEEDING AND FILTERING DEVICE

(75) Inventor: Paolo Alessandro Sommacal, Padua (IT)

(73) Assignee: Solvay Chimica Italia S.p.A., Rosignano Solvay (IT)

( * ) Notice: Subject to any disclaimer, the term of this patent is extended or adjusted under 35 U.S.C. 154(b) by 0 days.

(21) Appl. No.: 10/537,207

(22) PCT Filed: Jun. 19, 2003

(86) PCT No.: PCT/IT03/00379

§ 371 (c)(1),
(2), (4) Date: Dec. 5, 2005

(87) PCT Pub. No.: WO2004/050305

PCT Pub. Date: Jun. 17, 2004

(65) Prior Publication Data

US 2006/0135048 A1 Jun. 22, 2006

(30) Foreign Application Priority Data

Dec. 4, 2002 (IT) ..... PD2002A0309

(51) Int. Cl.
*B24C 9/00* (2006.01)

(52) U.S. Cl. ..... 451/89; 451/88; 451/90

(58) Field of Classification Search ..... 451/38, 451/39, 40, 87, 88, 89, 90, 446
See application file for complete search history.

(56) References Cited

U.S. PATENT DOCUMENTS

| | | | | |
|---|---|---|---|---|
| 3,300,902 | A * | 1/1967 | Dockery | 451/89 |
| 4,505,077 | A * | 3/1985 | Sheesley et al. | 451/2 |
| 4,610,113 | A * | 9/1986 | Fagerroos | 451/88 |
| 5,177,911 | A * | 1/1993 | Ruemelin et al. | 451/89 |
| 5,431,593 | A * | 7/1995 | Puschner | 451/75 |
| 5,556,324 | A * | 9/1996 | Shank, Jr. | 451/89 |
| 6,263,624 | B1 * | 7/2001 | Hoy et al. | 52/200 |
| 6,390,898 | B1 | 5/2002 | Pieper | |

* cited by examiner

*Primary Examiner*—Eileen P. Morgan

(57) ABSTRACT

An abrasive cleaning apparatus comprising a single-block plastic blasting booth having a front wall, a rear wall, a top wall, a bottom wall, and side walls, wherein at least a portion of one of the side walls defines an opening closeable by a door, thereby providing access inside the single-block blasting booth, and wherein one or more gaskets create a hermetic seal between the single-block blasting booth and the openable side wall portion, the one or more gaskets being provided on one or more of the opening and the door. The abrasive cleaning material may comprise sodium bicarbonate or a granular mixture containing sodium bicarbonate.

12 Claims, 4 Drawing Sheets

ABRASIVE CLEANING PLANT WITH SINGLE-BLOCK PLASTIC BOOTH AND INTEGRATED FEEDING AND FILTERING DEVICE

BACKGROUND OF THE INVENTION

1. Field of the Invention

The present invention concerns an abrasive cleaning apparatus by a blasting process, and, more particularly, a apparatus suitable for the abrasive cleaning of small and medium size object.

2. Description of Related Art

In the prior art, the cleaning of metal and non-metal objects, especially objects with rigid surfaces on which deposits such as grease, oil and paint are deposited, is performed by means of sandblasting, which consists of projecting towards the objects, by means of pressurized air, granules of sand or of other solid material, in order to remove by abrasion all the substances that have adhered to the object to be cleaned.

Basically, a flow of pressurized air, conveyed in a Venturi tube, sucks the sand or, in general, the granular abrasive material from a tank and conveys it to a delivery nozzle from which it is discharged at high speed.

Alternatively, a pressure tank may be adopted containing the abrasive material which is then sucked from the tank and projected onto the object to be cleaned.

Some sandblasting procedures include the use of water in addition to air and the granular abrasive material, for a more efficient elimination of the particles to be removed. The operator directs the nozzle towards the object to be cleaned, thus projecting the granular abrasive material onto the surfaces of the object to be cleaned.

The sandblasters in the prior art also comprise a sandblasting booth, a vacuum suction system for the granular abrasive material, and a filtering system for the air leaving the booth.

The booth consists basically of a hollow structure provided with an access door, a glass inspection window, two holes with long-sleeved gloves, and an outlet at the bottom. The sandblasting booth is designed to accommodate the object to be cleaned and is provided with a hopper base for the outflow of the air and solid parts (particles removed and sand or granular abrasive material).

The inner portion of the booth contains the nozzle for the emission of the air and the sand or granular abrasive material.

The front wall of the sandblasting booth is provided with a glass window for checking the sandblasting process and with two gloves with sleeves, extending inside the sandblasting booth and accessible from the outside, to allow the operator to handle the sandblasting nozzle and rotate the object to be cleaned.

The feed system for the granular abrasive material is installed separately from the sandblasting booth and comprises upstream a pressurized air source and downstream at least one sandblasting nozzle housed in the sandblasting booth.

The sandblasting booth discharge hopper is connected to the suction and separation system for the fumes leaving the booth, said system being designed in such a way as to separate the solid parts (particles removed and abrasive material) from the air.

The sandblasters in the prior art have a number of disadvantages.

First, the sandblasting booths of the sandblasters in the prior art are made of bent and welded sheet metal or fiberglass.

The closed booths made of sheet metal are very noisy, as the air emitted under pressure from the sandblasting nozzle generates sound waves which are amplified by the metal walls of the sandblasting booth. Further, the sand or granular abrasive material projected onto the object to be cleaned and the metal walls of the sandblasting booth generate noise, causing the vibration of the metal walls of the sandblasting booth.

The various walls and metal and sheet metal parts are joined by welding, and the welding spots, which generally correspond to the bending corners, can be naturally porous due to the addition of filler metal during the welding process. This problem is amplified by the fact that in sheet metal welding it is not possible to add significant quantities of filler metal.

Furthermore, the gaskets employed in the prior art are subject to involuntary treatment with the abrasive jet, with a consequent rapid deterioration. After a short time the booth is no longer sealed, with consequent loss of abrasive material, which is harmful for the users. This porosity or microporosity causes also a loss of material, or water in the versions with water, which can occur even after a relatively short time of use. If the construction material employed is not stainless steel, the problem could be further accelerated due to the corrosion that occurs as a result of oxidation of the above porosity points.

If aggressive chemical agents are used in the sandblasting process, for example degreasers or solvents, the metal walls and the welding lines are affected by the action of said chemical agents, which can trigger metal corrosion or oxidation.

Closed metal booths also require skilled labor for the welding of the various internal and external supports for connecting the various parts to the structure, such as the hinges for the loading door, the brackets for the door locks, the supports for the delivery means, etc.

The objects placed inside the closed booths and turned on their various sides for cleaning may also be inadvertently pushed against the metal walls, which can be surface damaged, deformed or seriously damaged.

Further, closed booths made of metal are very heavy due to the construction material used, with consequent problems of transportation, installation and subsequent handling.

Closed booths made of fiberglass partly dampen the noise and can absorb occasional shocks, but are also affected by the abrasive action of the sand or abrasive material in granules, consequently wearing out and producing and accumulating glass dust in the hopper, in the outlet and in the filtering system.

In addition to the above problems strictly relating to closed booths, there are other disadvantages concerning the entire sandblasting system.

The various parts of the current sandblasters (sandblasting booth, suction system for sand or granular abrasive material and filtering system) constitute independent elements interconnected by ducts, pipes and cables. All these separate parts require space for installation and maintenance; furthermore the various pipes, ducts and cables hinder the transit and work of the operator.

If the operator is required to modify the sandblaster operating parameters, for example, pressure, quantity of sand or granular abrasive material, or amount of water or other liquids, he must interrupt the sandblasting operation, in order to access the suction system and make the necessary modifications.

BRIEF SUMMARY OF THE INVENTION

One aim of the present invention is to provide a cleaning apparatus with a blasting booth that can optimally withstand shocks and wear.

A further aim of the present invention is to produce a cleaning apparatus with blasting booth walls whose structure and materials are suitable for soundproofing the inside from the outside of the blasting booth.

A further aim of the present invention is to improve the operator's working conditions from the environmental point of view, reducing noise and polluting emissions.

A further aim of the present invention is to provide a cleaning apparatus resistant to chemical agents.

A further aim of the present invention is to provide a cleaning apparatus with various parts combined in one single body, or in any case assembled as one single body.

A further aim of the present invention is to provide a cleaning apparatus using sodium bicarbonate, mixtures thereof and/or similar means as cleaning material.

A further aim of the present invention is to provide a cleaning apparatus with controls for adjusting and mixing pressurized air, for feeding abrasive or granular cleaning material, and for adding water or liquids, said controls being located beside the operator's position or in any case being easily and immediately accessible by the operator.

A further aim of the present invention is to provide a prefabricated cleaning system requiring less labor and less time for its manufacture and assembly.

A further aim of the present invention is to provide a cleaning apparatus weighing less than the apparatus in the prior art.

The present invention concerns a new cleaning apparatus with blasting booth consisting of plastic walls formed by a single plastic sheet, or by two plastic sheets substantially parallel to each other that may be joined at the edges.

The present invention further concerns a new cleaning apparatus with blasting booth comprising one single continuous element, i.e. a single-block.

The present invention further concerns a new cleaning apparatus using sodium bicarbonate, mixtures thereof, or similar means as a cleaning material.

The present invention further concerns a new cleaning apparatus with a device for feeding the granular abrasive material that is incorporated in the structure of the cleaning apparatus.

The present invention further concerns a new cleaning apparatus with air and waste water filtering device incorporated in the structure of the cleaning apparatus.

BRIEF DESCRIPTION OF THE SEVERAL VIEWS OF THE DRAWINGS

The attached drawings are intended to facilitate the description of the invention and illustrate one embodiment of the invention. Said drawings are not intended to restrict the nature of the inventive concept.

DETAILED DESCRIPTION OF THE INVENTION

The detailed description of an embodiment of the invention is provided herein. It is to be understood, however, that the present invention may be embodied in various forms. Therefore, the specific details disclosed herein are not to be interpreted as limiting, but rather as a representative basis for teaching one skilled in the art how to employ the present invention in virtually any detailed system, structure, and manner.

Figure 1:
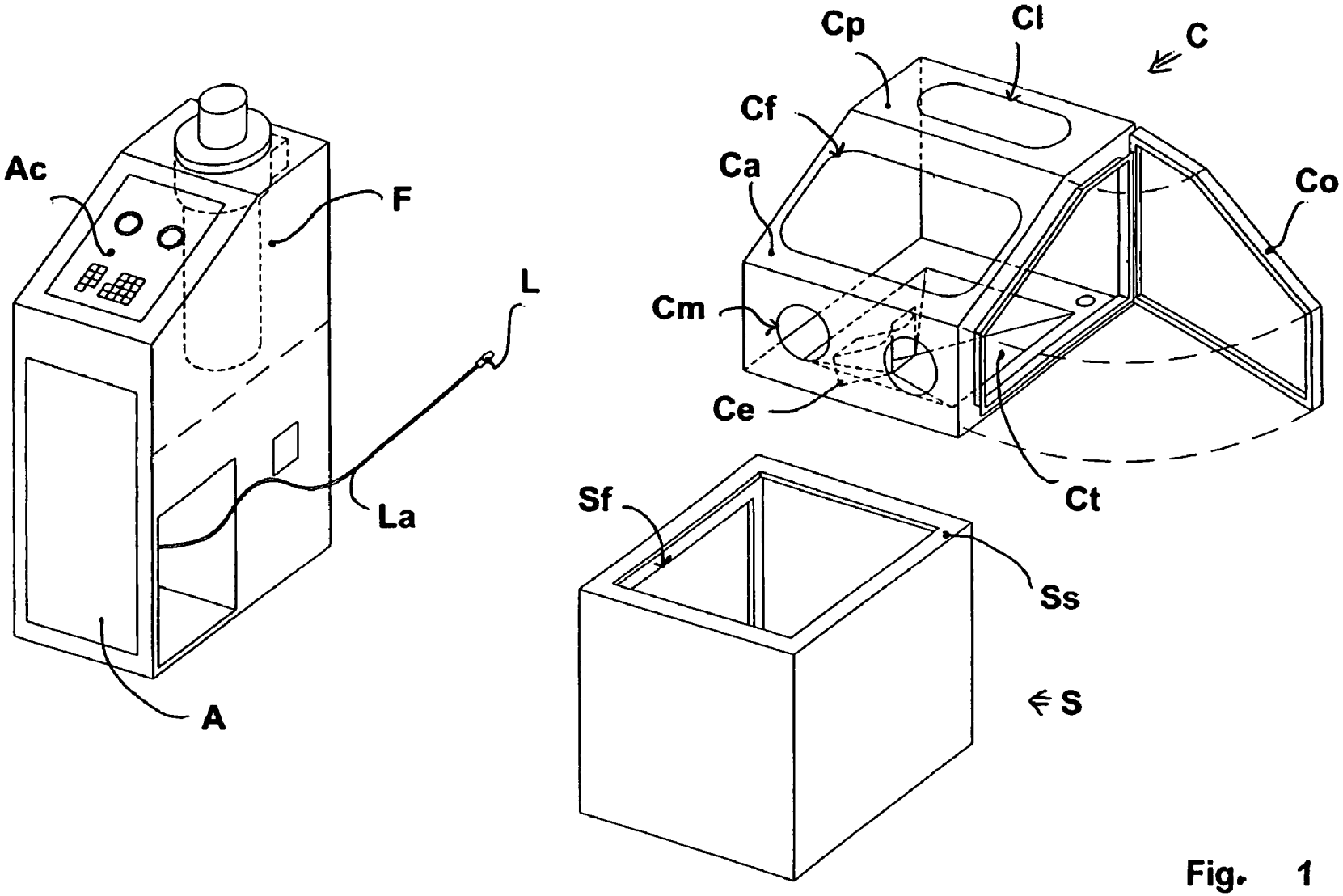
FIG. 1 shows an exploded view of the various component parts, illustrated separately, of the abrasive cleaning apparatus which comprises at least one blasting booth (C), a base or support (S) for the blasting booth (C), a feeding device (A) for the abrasive material in granules and a filtering device (F).

Turning first to FIG. 1, there is shown a first embodiment of the invention comprising a blasting booth (C), a support (S) for the blasting booth (C), a feeding device (A) for the abrasive or cleaning material in granules, and a filtering device (F).

The blasting booth (C) is formed as a single-block, that is, is shaped as a single continuous element, and comprises a plurality of walls (Cp) designed to enclose an area adequate to contain the objects to be cleaned, in addition to permitting their rotation and movement, so that cleaning can be performed on all the surfaces and sides of the objects to be cleaned. When a plastic material is employed, walls (Cp) are molded together as a single component. The term "molded" is used herein to indicate the shaping of a plastic material, rather than to indicate the injection molding process only.

A door (Co) of the blasting booth (C), preferably situated along a vertical side wall, is hinged to an opening on one of the walls (Cp), thus permitting access to the inside of said blasting booth (C) to position or withdraw the objects to be cleaned. The door (Co) may be as large as to replace one of the walls (Cp).

Such opening and/or the edge of the door (Co) are provided with gaskets designed to ensure a hermetic seal.

The walls (Cp) and the door (Co) of the blasting booth (C) may be formed by one or two plastic sheets. When two plastic sheets are employed, such sheets may be substantially parallel to each other and may be joined at the edges. The plastic used to produce the walls (Cp) and the door (Co) of the blasting booth (C) is preferably polyethylene (PE), polyvinyl chloride (PVC), polypropylene (PP), ABS, a reinforced plastic, other similar materials or mixtures, or derivatives of the same.

One of the walls (Cp) of the blasting booth (C), preferably the front wall (Ca), features an inspection window (Cf) and two holes (Cm) positioned side by side. The inspection window (Cf) consists of an opening in the wall (Ca) provided with a transparent material, such as a transparent glass, and is designed to allow the operator to observe the inside of the blasting booth (C). The two holes positioned side by side (Cm) are provided with two long gloves made of a flexible plastic material and facing the inner portion of the blasting booth (C), in order to enable the operator to manipulate the objects inside the blasting booth (C) without coming into direct contact with such objects and at the same time preventing the outflow of air and suspended particles (sodium bicarbonate, salts in general, granules of abrasive material, and removed particles) that may be present inside the blasting booth (C). A recess (Cl) is provided at the top for a light fixture.

The lower wall of the blasting booth (C), i.e. the bottom wall (Ct), is hopper-shaped in order to collect and convey all the free particles (granules of abrasive material and removed particles) present inside the blasting booth (C) towards an outlet duct (Ce). The delivery means with a nozzle (L) for the emission of an air jet and of the granular abrasive material are connected to the feeding device (A) and are also housed inside the blasting booth (C). These delivery means with nozzle (L) are connected to the feeding device (A) by means of a suitable hose (La).

The blasting booth (C) constructed as described above is sustained by an adequate support (S), generally consisting of a box-shaped base, open at the top (Ss) to accommodate the hopper-shaped bottom (Cf) of the blasting booth, and provided with an opening (Sf) on the side wall facing the filtering device (F) for the connection of the outlet pipe (Ce) of the blasting booth (C) hopper (Cf) to the filtering device (F) and/or damp parts separator.

Figure 2:
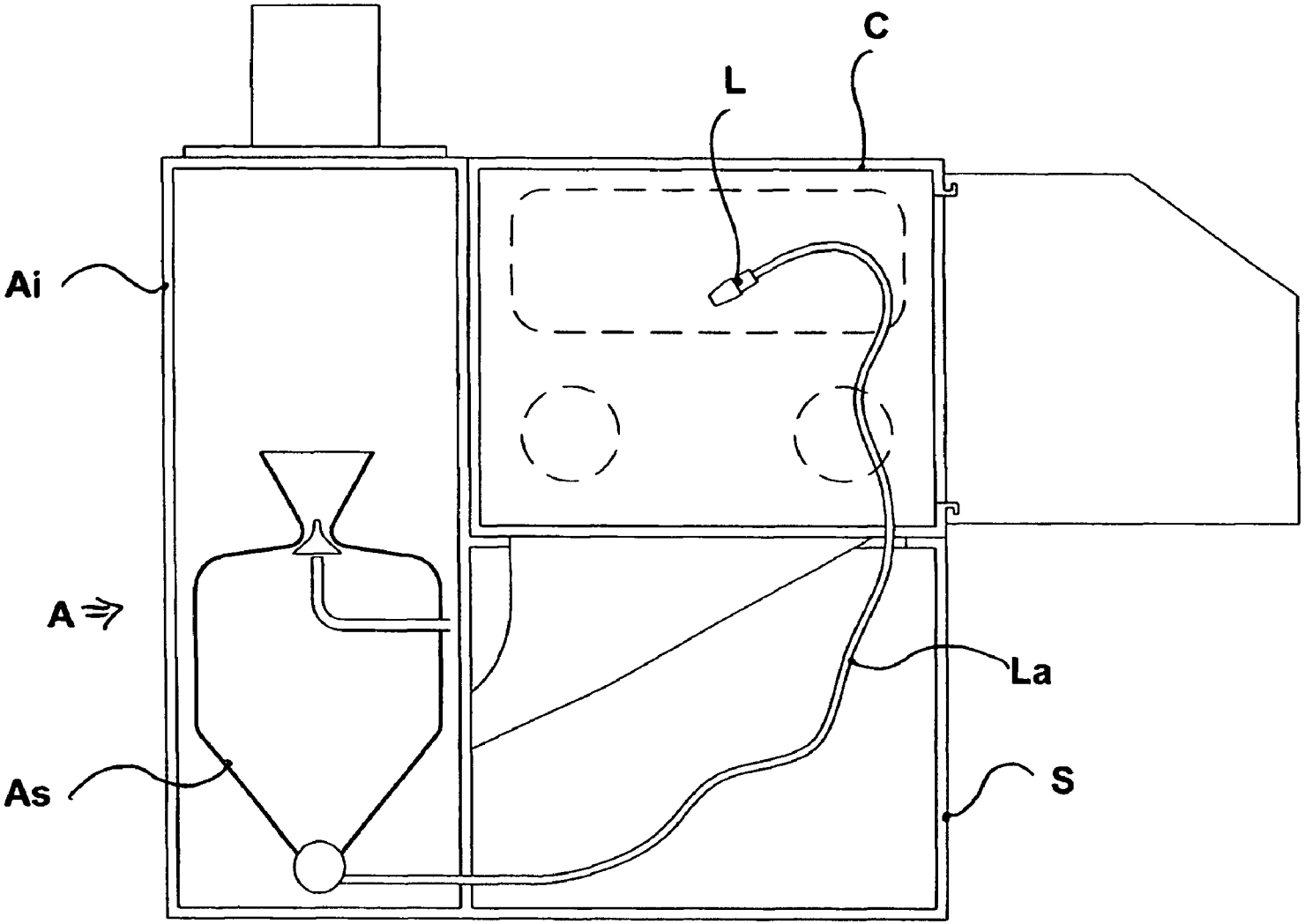
FIG. 2 shows a vertical cross section of the abrasive cleaning apparatus of FIG. 1.

Turning now to FIG. 2, it can be seen that the feeding device (A) comprises a shell structure (Al), whose size and profile are such as to be laterally coupled with the blasting booth (C), and houses at least one tank (As) for the granular abrasive material and a device for sucking the granular abrasive material from the tank (As) and mixing it with compressed air and/or water.

The feeding device (A) is provided on its upper front wall with the controls and instruments (Ac) for controlling the operation of the feeding device (A) itself.

During operation, the feeding device (A) is connected to a pressurized air line and a pressurized water line, and operates by sucking the abrasive material from the tank (As) and conveying it via the hose (La) to the delivery means with nozzle (L) housed in the blasting booth (C).

Alternatively, a tank containing the pressurized abrasive material can be provided, from which the material flows out at an adjustable speed.

The feeding device (A) is dimensioned to be laterally coupled with the blasting booth (C), so that the controls and instruments (Ac) for controlling said feeding device (A) are beside the inspection window (Cf) and the two holes (Cm) in the blasting booth (C).

Figure 3:
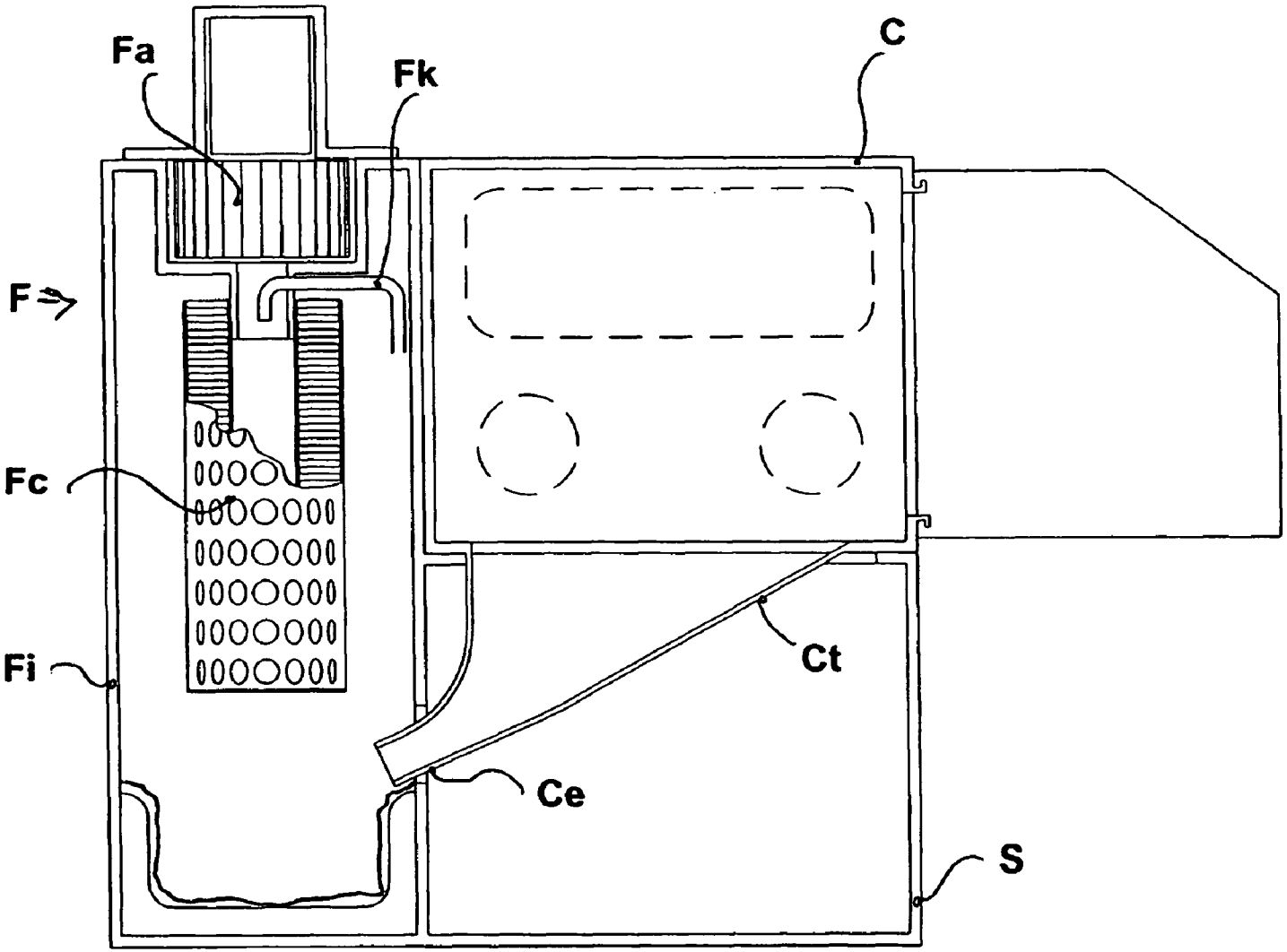
FIG. 3 shows another vertical cross section of the abrasive cleaning apparatus of FIG. 1.

Turning now to FIG. 3, there is shown the filtering device (F), which comprises a shell structure (Fi) whose size and profile are such as to be coupled with the blasting booth (C) on one side, and to be coupled at the rear with the feeding device (A), inside which there are a suction device (Fa) and a cartridge filter(s) (Fc) provided with a cleaning duct (Fk).

Further, the filtering device (F) is dimensioned to be coupled with the support (S) of the blasting booth (C) and with the side opening (Sf) of the support (S).

The shell structure (Fi) of the filtering device (F) is provided at one side with a hole or opening (Ff) suitable for being coupled with said support (S), so that the outlet pipe (Ce) of the blasting booth (C) hopper (Ct) runs into the filtering device (F).

The blasting booth (C) with the support (S), the feeding device (A) and the filtering device (F) are designed to couple and connect reciprocally, forming one single element which can be split into its various parts for transportation, movement and handling.

The new cleaning apparatus with having a blasting booth made as a single plastic structure with an opening closeable by a hinged door, and further having integrated feeding and filtering devices constructed as described above, offers numerous advantages.

The above described embodiment has very compact dimensions, since the blasting booth (C), the feeding device (A), the filtering device (F) and the dust and/or waste water outlet separator are integrated within a single area without affecting functionality.

The construction material and shape of the walls (Cp) of the blasting booth (C) do not produce the soundbox effect normally generated in blasting booths in the prior art, reducing the overall noise level of the apparatus.

The plastic material used is not porous and is not subject to corrosion or oxidation. Because the blasting booth (C) is built in one single element, there are no joints with possibility of breakage and outflow of material.

Because the blasting booth (C), and also the support (S) and the shell structures (Al, Fi) of the feeding device (A) and/or filtering device (F), can each be produced as individual components manual operations and labor for the assembly and fixing of the various parts are considerably reduced.

The molding manufacturing process of the plastic material provides greater precision in the repeatability of the pieces than in the prior art, avoiding the risk of human error.

All of the above features, therefore, provide for reduced assembly times and consequently overall production costs.

The use of plastic material for the production of various parts of the new cleaning apparatus also limits the weight of the apparatus as a whole, with consequent advantages for transportation and the possibility of removing and relocating the apparatus at any time with no need to use special equipment. The use of plastic material for the production of various parts of the cleaning apparatus in the present embodiment, and in particular for the blasting booth (C), provides for increased resistance of the various parts and in particular of the blasting booth (C) itself to shocks.

Further, the cleaning apparatus according to the present embodiment is not subject to corrosion and/or oxidation caused by any chemical substances used in the cleaning process, as the blasting booth (C) and the various conduits, if made of plastic, do not oxide but instead withstand corrosion.

Figure 4:
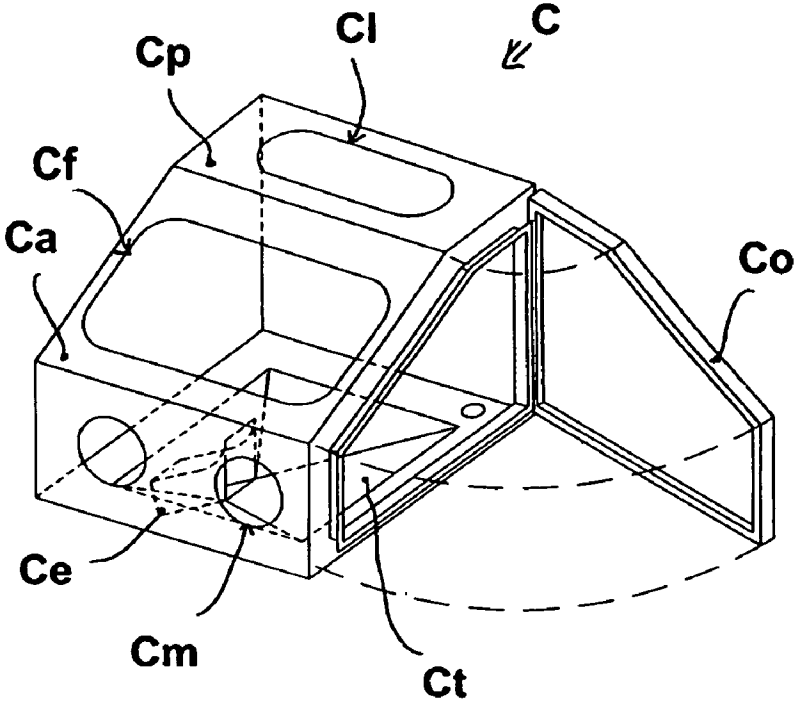
FIG. 4 shows an exploded view of a variant of the embodiment of FIG. 1.
Figure 4:
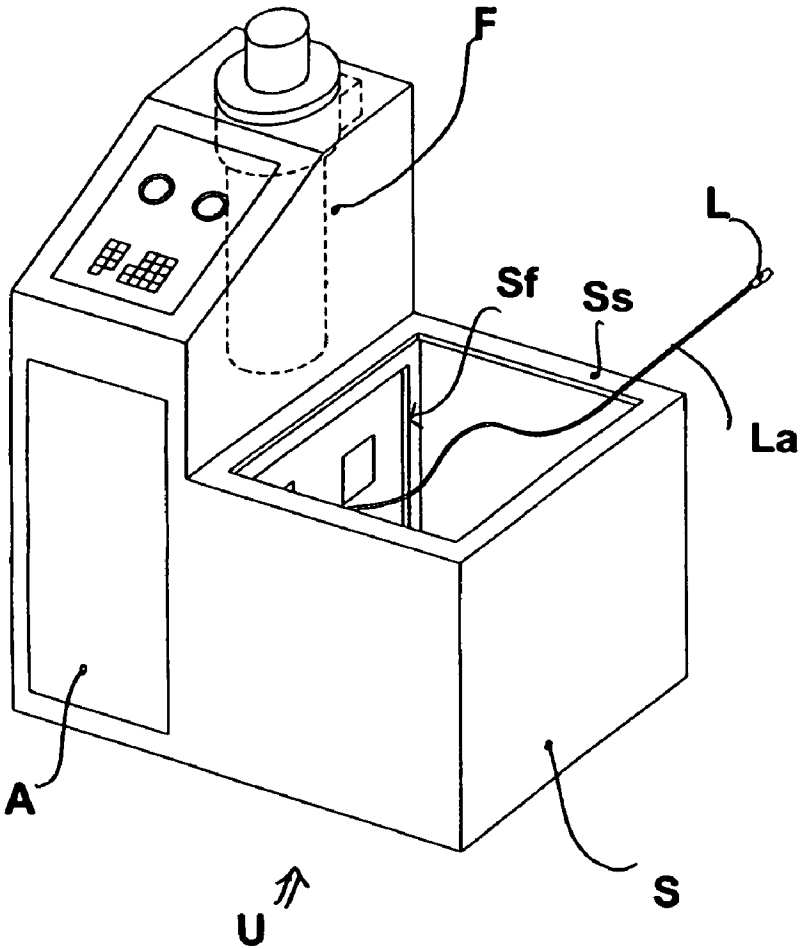

As shown in FIG. 4, the base (S) and the shell structures (Pi) and (Al) may be made in one single element provided with side and/or upper openings for fitting the above described pieces of equipment.

Therefore, with reference to the above description and the attached drawing, the following claims are put forth.

The invention claimed is:

1. An abrasive cleaning apparatus comprising:

a blasting booth having a front wall, a rear wall, a top wall, a bottom wall, and side walls, a support structure for the blasting booth;

a feeding device providing a granular blasting material to the blasting booth; and a plastic filtering device filtering the blasting material exiting the blasting booth, the filtering device being in flow communication with the blasting booth, wherein the blasting booth is molded as a single component in plastic material, wherein at least a portion of one of the walls of the blasting booth comprises an opening closeable by a door rotatable on a hinge that connects the blasting booth with the door, the opening providing access to the interior of the blasting booth, wherein one or more gaskets create a hermetic seal between the blasting booth and the door, the one or more gaskets being provided on one or more of the opening and the door, and wherein the blasting booth, the support structure, and the feeding device are individual components assemblable to form the abrasive cleaning apparatus during use, and separable for transportation, movement and handling.

2. The abrasive cleaning apparatus according to claim 1, wherein at least a portion of the front wall is sloped, wherein an inspection window comprising a transparent surface is provided in the front wall, and wherein two holes are provided in the front wall, the two holes being positioned side by side and being structured for having a work glove extending from each of the two holes.

3. The abrasive cleaning apparatus according to claim 1, wherein one or more of the walls of the blasting booth comprise two plastic sheets substantially parallel to each other.

4. The abrasive cleaning apparatus according to claim 3, wherein an insulating material is provided between the two plastic sheets.

5. The abrasive cleaning apparatus according to claim 1, wherein the bottom wall is shaped like a hopper and is connected to an outlet pipe.

6. The abrasive cleaning apparatus according to claim 1, wherein the support structure is box-shaped and open on one side to accommodate the hopper-shaped bottom wall of the blasting booth, and wherein a side wall of the support structure is provided with an opening facing the filtering device and enabling a connection of the outlet pipe with the filtering device.

7. The abrasive cleaning apparatus according to claim 1, wherein the feeding device is housed in a shell structure having a size and a profile adequate to be coupled with one side wall of the blasting booth.

8. The abrasive cleaning apparatus according to claim 1, wherein the shell structure houses at least one tank containing a blasting material, and wherein the blasting material is delivered inside the single-block blasting booth through means for delivering the blasting material.

9. The abrasive cleaning apparatus according to claim 8, wherein the means for delivering the blasting material are connected to the tank with a tubular structure having a nozzle at the end opposite to the tank.

10. The abrasive cleaning apparatus according to claim 1, wherein the support structure, the feeding device, and the filtering device are coupled to form a L-shaped apparatus.

11. The abrasive cleaning apparatus according to claim 1, wherein the filtering device is housed within a filtering shell structure, and wherein the filtering device comprises a suction device providing an exit flow of gases from the filtering device, and a cartridge filter connected to the suction device.

12. The abrasive cleaning apparatus according to claim 8, wherein the blasting material comprises sodium bicarbonate or a mixture of granular elements comprising sodium bicarbonate.

* * * * *